United States Patent [19]

Wagg

[11] 4,307,704

[45] Dec. 29, 1981

[54] STOVE ASH RETAINING APPARATUS

[76] Inventor: Charles Wagg, R.R. #1, Box 118D, Cream Ridge, N.J. 08514

[21] Appl. No.: 134,410

[22] Filed: Mar. 27, 1980

[51] Int. Cl.[3] ..... F23J 1/00; F25J 1/42

[52] U.S. Cl. ..... 126/245; 126/243; 220/3

[58] Field of Search ..... 126/242, 243, 245; 220/2, 3

[56] References Cited

U.S. PATENT DOCUMENTS

| | | | |
|---|---|---|---|
| 767,648 | 8/1904 | Korjibsky | 126/242 |
| 879,622 | 2/1908 | Galvin | 126/242 |
| 1,056,572 | 3/1913 | Nadeau | 220/2 |
| 1,477,930 | 12/1923 | Bartholomew et al. | 126/243 |
| 1,767,312 | 6/1930 | Russell | 126/242 |

*Primary Examiner*—Samuel Scott
*Assistant Examiner*—Wesley S. Ratliff, Jr.
*Attorney, Agent, or Firm*—John J. Kane; Frederick A. Zoda; Albert Sperry

[57] ABSTRACT

A stove ash retaining device is disclosed for use with stoves and furnaces having an ash pit which serves as the combustion chamber also simultaneously. The retaining apparatus includes a housing having a floor, sidewalls, a top and an end to define an open end thereof adapted to admit ashes therethrough. The open end includes a cover movably positionable extending thereover to prevent the moving of light ash therefrom during disposal of ashes. The housing includes an inclined entry ramp extending downwardly therefrom adapted to extend into an ash pit over the edge of an ash door of a conventionally configured stove. The apparatus further includes a tool device including a rake for separating the ashes from the coals and a hoe for pulling the separated ash up the inclined entry ramp into the retaining chamber therefore defined by the housing. The cover is then placed across the opening prior to removal of the inclined entry ramp from the stove and upon such removal the ash within the chamber may be relocated for disposal thereof without chance of loss of ash into the surrounding environment.

11 Claims, 3 Drawing Figures

STOVE ASH RETAINING APPARATUS

BACKGROUND OF THE INVENTION

1. Field of the Invention

The present invention relates to devices to facilitate the removal of ashes from ash pits of furnaces or stoves. The problem addressed by such removal devices is that ash normally is extremely lightweight or low in density such that a disturbing of ash produces a floating debris which is difficult to confine and often results in spoiling the surrounding environment such as the living room adjacent to a fire place or wood burning stove. Of course the problem only deals with those types of stoves, furnaces or fire places which do not have their own ash removal conduit therebelow or somewhere therein. However, with most stoves it is necessary to actually remove the ash through an ash door in order to discard the ash as necessary.

A particular problem arises with this types of stoves and furnaces wherein the combustion chamber and the ash pit are a single location. That is, in some types of stoves or furnaces a grate is utilized which holds the combustible materials at a location elevated with respect to the ash pit. In such stove configurations the ash pit and the combustion chamber are not in the same location, namely, the combustion chamber is immediately above the grate whereas the ash pit is located therebelow. In other types of devices and in particular, wood burning stoves, the ash pit and the combustion chamber are in the same location due to the absence of usage of a grate. It is this type of stove or furnace to which the present invention is directed. This invention does not relate to those types of devices usable with stoves having the coals or combustible materials separated from the ash. The most particular type of device wherein the ash pit and the combustion chamber are in one location is a wood burning stove wherein combustible wood to be burned is placed directly into the ash. With this configuration, the present invention is particularly usable since the tool means includes a rake section having teeth therein which when moved rearwardly will separate coals from the ash. The tool means also includes a hoe section which can, after separation of the ash from the coals, can pull the ash up the inclined ramp into the retaining chamber of the present invention.

2. Description of the Prior Art

Many types of devices have been designed and patented to remove ashes in a dustless fashion such as U.S. Pat. Nos. 879,622; 670,767; 631,812; 1,095,276; 767,648; and 1,767,312. All of these devices however are distinguishable from the present invention since they are designed particularly for usage with stoves or furnaces having multiple sections wherein one section is designed above the grate as the combustion chamber and another section is designed below the grate as the ash pit. The present invention is not designed to be particularly usable with such stoves and furnaces.

SUMMARY OF THE INVENTION

The present invention provides a stove ash retaining apparatus which is particularly usable with stoves and furnaces having an ash pit which simultaneously serves also as the combustion chamber. The retaining apparatus includes a housing means which has a floor means with a pair of sidewalls extending upwardly at opposite sides therefrom. The housing means further includes a top which extends approximately horizontally over the floor and connects the upper edges of the sidewalls. The housing further includes an end wall means which extends upwardly from the floor means to the top means and interconnects one end of the sidewall means. in this manner the housing means defines an open end thereof between the sidewalls which is adapted to receive ash passed therethrough into the interior ash retaining chamber which is defined by the upper surface of the floor and the lower surface of the top and the interior surfaces of each sidewall means and the end means.

The retaining apparatus also includes an inclined entry ramp which is fixedly secured with respect to the floor of the housing adjacent the open end thereof and extending preferably downwardly and forwardly therefrom to the bottom of the wood stove to provide a path for the movement of ashes upward therealong into the chamber when the inclined entry ramp extends into an ash pit of a wood burning or other type of stove or furnace. The ash retaining apparatus further includes an entry side means which extend upwardly from each end of the inclined entry ramp therealong to prevent the loss of ash during the movement of the ash along the inclined entry ramp into the ash retaining chamber. Preferably, the entry sidewalls are continuous and integral with respect to the sidewall means of the housing means to thereby facilitate the flow of ash thereto without loss thereof.

The apparatus further includes a cover means which is movable and pivotally secured with respect to the housing to be capable of being placed over the open end and thereby as required and desired, seal the ash retaining chamber from the external environment when the inclined entry ramp and the entry side means extend into the ash pit of the stove. The apparatus further includes a tool which is selectively positionable extending over the inclined entry ramp and between the entry side means into the ash pit of the stove to be movable with respect thereto to pull ash upwardly along the inclined entry ramp into the ash retaining chamber defined within the housing means in a manner such as to prevent the loss of ashes into the surrounding environment.

Preferably the tool means includes a rake section having teeth therein to facilitate separation of the coals from the ash within the stove or furnace. The tool further preferably includes a hoe section to facilitate the pulling of ash from the stove up the inclined entry ramp into the ash retaining chamber. Further, particularly, it is preferable to provide the housing with a handle means to facilitate holding and movement thereof and to provide the movable cover with a handle means to facilitate selective placement over the opened end of the housing.

It is an object of the present invention to provide a stove ash retaining apparatus particularly usable with stoves and furnaces having an ash pit which simultaneously functions as the combustion chamber thereof also.

It is an object of the present invention to provide a stove ash retaining apparatus which may be handheld during usage.

It is an object of the present invention to provide a stove ash retaining apparatus particularly usable with wood stoves which have combination combustion chamber and ash pit and have no grate.

It is an object of the present invention to provide a stove ash retaining apparatus for use with stoves and furnaces having an ash pit which simultaneously serves as a combustion chamber which is "air-tight" wherein the burning is controlled by air vent openings rather than by the amount of fuel used.

It is an object of the present invention to provide a stove ash retaining apparatus which is simple in design and easily maintained.

It is an object of the present invention to provide a stove ash retaining apparatus which is fully functional and yet financially feasible.

It is an object of the present invention to provide a stove ash retaining apparatus which separates ash from wood and embers.

It is an object of the present invention to provide a stove ash retaining apparatus for use with stoves and furnaces having combined combustion chamber and ash pit which utilizes the stove draft to pull ash back into the stove.

It is an object of the present invention to provide a stove ash retaining apparatus which includes an ash trap which partially blocks the ash door thereby increasing the draft around the apparatus.

It is an object of the present invention to provide a stove ash retaining apparatus including sides on the ramp to help guide ash into the ash retaining enclosure.

It is an object of the present invention to provide a stove ash retaining apparatus which can be closed while still in the chamber by the movement of a cover or door over the opening to the ash retaining enclosure.

It is an object of the present invention to provide a stove ash retaining apparatus which facilitates cleaning of stoves and furnaces with which it is used.

It is an object of the present invention to provide a stove ash retaining apparatus which includes a tool having a hoe blade on one side to pull the ashes into the ash trap and a rake on the other side to separate the wood and embers from the ashes.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
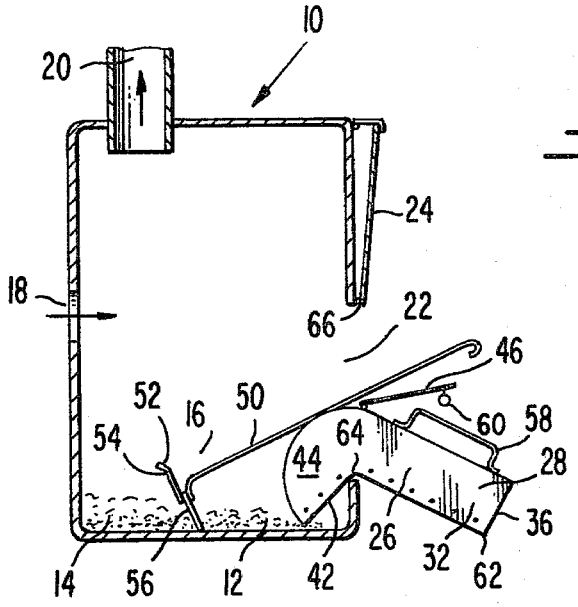
FIG. 1 is a side cross-sectional view of an embodiment of the stove ash retaining apparatus of the present invention shown in place within a conventional stove or furnace.
Figure 2:
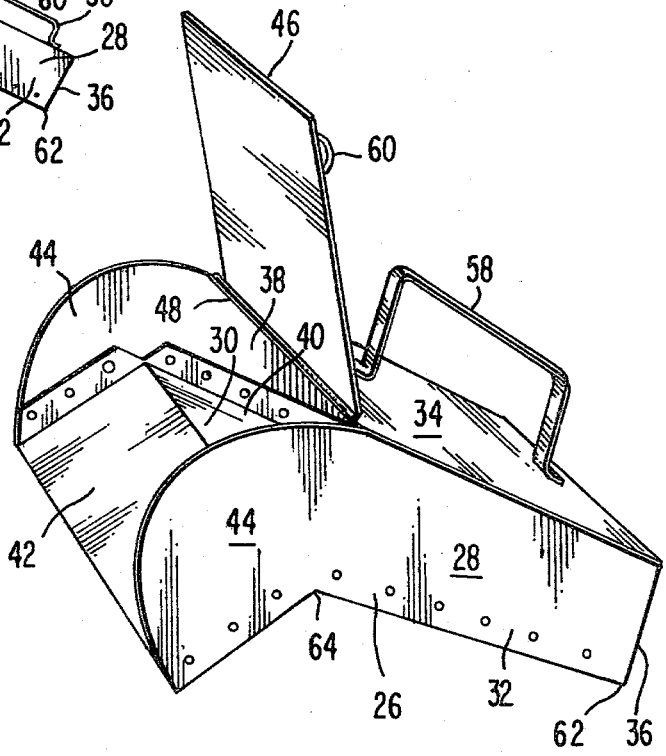
FIG. 2 is a perspective view of an embodiment of the stove ash retaining apparatus of the present invention.
Figure 3:
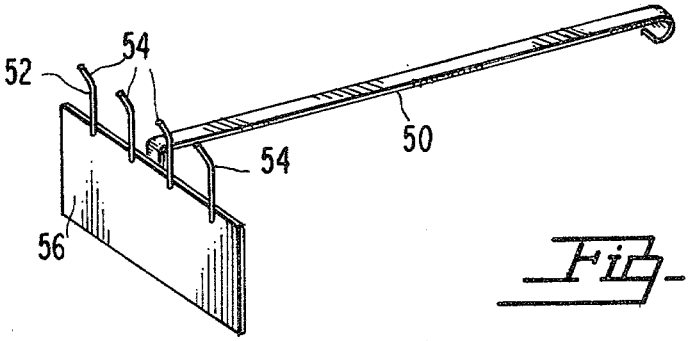
FIG. 3 is a perspective view of a preferred embodiment of the tool portion of a stove ash retaining apparatus of the present invention.

The present invention provides a stove ash retaining apparatus 26 which is particularly usable positioned extending through the ash opening 22 thereof. A wood burning stove or furnace 10 normally includes an ash pit 16 which also functions as the combustion chamber. That is, with such a stove 10, there is no grate and as such the ashes 12 accumulate in the same area or locations as the coals 14 or other combustible material utilized for burning. With such configurations, it is conventional to include an air inlet 18 which provides a source of oxygen for combustion and an outlet flue 20 for the formation of the necessary chimney draft to insure continuous combustion.

The present invention provides an apparatus 26 which is particularly adapted to extend through the ash removal door 24 of the stove 10. The portion of the apparatus 26 which actually extends through the door would be the inclined entry ramp 42.

Ramp 42 is connected to the housing means 28 of the apparatus 26. Housing means 28 includes a floor means 30 and sidewall means 32 extending upwardly therefrom on opposite edges thereof. Housing 28 also includes a top means 34 extending between the upper edges of the sidewalls 32 and an end means 36 which closes one end of the housing to thereby define an ash retaining chamber therein. The end of the chamber 40 opposite from the end means 36 is open to provide an open end 38 to allow ash to be admitted therethrough.

Inclined entry ramp 42 abuts the floor means 30 of housing 28 to provide the path for the ashes to pass into the ash retaining chamber 40. To facilitate this movement of the ashes 12 the apparatus 26 includes entry side means 44 which are adapted to further guide the ashes into the chamber 40.

Once the ashes 12 are moved into the chamber 40 it is desirable to seal the chamber by closing the open end 38 thereof. This sealing is performed by the placing of a movable cover means 46 over open end 38. Preferably the movable cover means 46 is pivotally secured with respect to the top means 34 by a plurality of hinges 48.

To facilitate operation of the apparatus 26 a tool means 50 may be included therein. The tool means 50 preferably includes a rake section 52 including teeth means 54. This rake section 52 is particularly adapted to rake through the ash pit and combustion chamber 16 to separate the coals from the ash. Tool means 50 also includes a hoe section 56 which is adapted to rake the separated ash 12 up the inclined entry ramp 42 between entry side means 44 and into the ash retaining chamber 40.

To facilitate operation of the present invention the housing may include a housing handle means 58 to facilitate portability thereof and the movable cover may include a movable cover handle means 60 to facilitate movement of the cover between a closed position and an open position with respect to the open end 38 of the housing 28. If the housing 28 is not in a hand-held position by use of the housing handle means 58 it is possible to rest the rearmost edge 62 of the floor means 30 on the floor while simultaneously resting the stove resting edge 64 at the lower portion of the intersection between the inclined entry ramp 42 and the floor means 30 against the upper portion of the lower edge of the ash opening 22 and in this manner facilitate the raking of ash into the retaining chamber 40.

In operation the apparatus of the present invention 26 is best utilized initially by opening of a door 24 of a conventional wood stove 10. The inclined entry ramp 42 of the apparatus 26 is then moved into the ash pit area 16. At this point the floor resting edge 62 may be placed on the floor of the surrounding area and the stove resting edge 64 may be placed on the edge of the ash opening 22 or the entire housing may be held in position by the user holding the housing handle means 58.

Since the pit area 16 includes both ashes and combustible members, it is necessary to utilize the tool means 50 and in particular the rake section 52 thereof to rake the uncombusted materials to preferably the rearmost section of pit 16. Thereafter the hoe section 56 of the tool means 50 is utilized to hoe the ashes up the inclined entry ramp 42 of apparatus 26. Preferably this operation is performed during a time when the chimney of the stove 10 or the area immediately surrounding outlet flue 20 is still warm such that a normal chimney draft is being created. With this chimney draft and with the partial closing of the ash opening 22 by the placement of the housing 28 across the major proportion of this opening a large draft will be created inwardly between the apparatus 26 and the upper edge 66 of the ash opening 22. Thus with the cross-sectional area of the ash door 24 substantially closed the velocity of air or the amount of draft will be significantly increased and thereby any ash which is caused to float in the air as a result of the hoeing or raking operation of tool 50 within the stove 10 will be drawn by this draft inwardly back into the stove and upwardly through the outlet flue 20. Therefore a clean operation will be created without any soiling of the surrounding environment.

Once the substantial portion of the ashes 12 have been pulled from the pit 16 the movable coverings 46 may be moved into a position closing the open end 38 of the ash retaining chamber 40. The apparatus 26 may then be moved to a location for disposal of the ash from therein without any soiling of the environment outside of the stove 10. For these reasons and in consideration of this operation the present invention provides a novel stove ash retaining apparatus for use with stoves and furnaces having an ash pit which simultaneously serves as a combustion chamber.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A stove ash retaining apparatus, for use with stoves and furnaces having an ash pit which simultaneously serves as the combustion chamber with the ash removal door located above the ash pit, which comprises:

(a) a housing means including a floor means and a pair of sidewall means extending upwardly at opposite sides therefrom, said housing means further including a top means extending between said sidewall means and extending over said floor means, said housing means further including an end means extending upwardly from said floor means to said top means and interconnecting said sidewall means at one end thereof, said housing means defining an open end thereof between said sidewall means with said floor means extending obliquely downwardly therefrom, said floor means and said top means at the opposite end of said housing means from said end means, said housing means further defining an ash retaining chamber between the upper surface of said floor means and the lower surface of said top means and between the interior surfaces of said sidewall means and said end means;

(b) an inclined entry ramp fixedly secured to said floor means of said housing means adjacent said open end thereof and extending obliquely downwardly therefrom to provide a path for the movement of ashes upward therealong and down along said floor means into said ash retaining chamber when said inclined entry ramp extends into an ash pit of a stove;

(c) entry side means extending upwardly with respect to said inclined entry ramp along each side edge thereof to prevent the loss of ash during movement along said inclined entry ramp, said entry side means being continuous and integral with respect to said sidewall means of said housing means to facilitate the flow of ashes thereinto;

(d) a movable cover means pivotally secured with respect to said housing means to be selectively positionable over said open end thereof to selectively seal said ash retaining chamber from the external environment when said inclined entry ramp and said entry side means still extend into an ash pit of a stove; and (e) a tool means positionable extending over said inclined entry ramp and between said entry side means into an ash pit of a stove to be movable to pull ash therefrom up said inclined entry ramp and into said ash retaining chamber defined by said housing means.

2. The apparatus as defined in claim 1 wherein said tool means includes a rake section to separate coals from ash in the combined ash pit and combustion chamber of the stove.

3. The apparatus as defined in claim 2 wherein said rake section includes teeth means extending downwardly from said tool means and being inclined with respect thereto.

4. The apparatus as defined in claim 1 wherein said tool means includes a hoe section to facilitate pulling of ash from the stove up said inclined entry ramp into said ash retaining chamber.

5. The apparatus as defined in claim 1 further including a housing handle means to facilitate holding and movement of said housing means.

6. The apparatus as defined in claim 1 further including a movable cover handle means to facilitate holding and movement of said movable cover means.

7. The apparatus as defined in claim 1 wherein said housing means defines a floor resting edge on the exterior surface thereof along the inner section between said floor means and said end means.

8. The apparatus as defined in claim 1 wherein said housing means defines a stove resting means on the exterior surface thereof along the intersection between said floor means and said inclined entry ramp.

9. The apparatus as defined in claim 1 further including a hinge means pivotally securing said movable cover means with respect to said top means of said housing means.

10. The apparatus as defined in claim 1 wherein said inclined entry ramp and said floor means extend obliquely downward away from said open end of said housing means.

11. A stove ash retaining apparatus, for use with stoves and furnaces having an ash pit which simultaneously serves as the combustion chamber with the ash removal door located above the ash pit, which comprises:

(a) a housing means including a floor means and a pair of sidewall means extending upwardly at opposite sides therefrom, said housing means further including a top means extending between said sidewall means and extending over said floor means, said housing means further including an end means extending upwardly from said floor means to said top means and interconnecting said sidewall means at one end thereof, said housing means defining an open end thereof between said sidewall means, said floor means and said top means at the opposite end of said housing means from said end means, said floor means extending downwardly and rearwardly with respect to said open end, said housing means further defining an ash retaining chamber between the upper surface of said floor means and the lower surface of said top means and between the interior surfaces of said sidewall means and said end means; said housing means further including a housing handle means fixedly secured with respect thereto to facilitate holding and movement of said housing means, said housing means further including a floor resting edge on the exterior surface thereof along the intersection between said floor means and said end means;

(b) an inclined entry ramp fixedly secured to said floor means of said housing means adjacent said open end thereof and extending downwardly and forwardly therefrom to provide a path for the movement of ashes upward therealong and down along said floor means into said ash retaining chamber when said inclined entry ramp extends into an ash pit of a stove, said housing means further defining a stove resting means on the exterior surface along the intersection between said floor means and said inclined entry ramp;

(c) entry side means extending upwardly with respect to said inclined entry ramp along each side edge thereof to prevent the loss of ash during movement along said inclined entry ramp, said entry side means being continuous and integral with respect to said sidewall means of said housing means to facilitate the flow of ashes thereinto;

(d) a movable cover means pivotally secured with respect to said housing means to be selectively positionable over said open end thereof to selectively seal said ash retaining chamber from the external environment when said inclined entry ramp and said entry side means still extend into an ash pit of a stove, said movable cover means further including a movable cover handle means to facilitate holding and movement of said movable cover means; and (e) a tool means positionable extending over said inclined entry ramp and between said entry side means into an ash pit of a stove to be movable to pull ash therefrom up said inclined entry ramp and into said ash retaining chamber defined by said housing means, said tool means including:

1. a rake section to separate coals from ash in the combined ash pit and combustion chamber of the stove wherein said rake section includes teeth means extending downwardly from said tool means and being inclined with respect thereto; and
2. a hoe section to facilitate pulling of ash from the stove up said inclined entry ramp into said ash retaining chamber.

* * * * *